United States Patent [19]

Waller

[11] 4,365,854

[45] Dec. 28, 1982

[54] CABINET CONSTRUCTION

[76] Inventor: Gary G. Waller, 818 Sommerville St., Shakopee, Minn. 55379

[21] Appl. No.: 180,940

[22] Filed: Aug. 25, 1980

[51] Int. Cl.[3] ..... A47B 53/00; A47B 91/00

[52] U.S. Cl. ..... 312/250; 312/198; 312/238; 312/317 R

[58] Field of Search ..... 312/250, 238, 239, 198, 312/199, 201, 202, 204, 245, 317; 109/45, 49; 5/2 B, 2 R, 8

[56] References Cited

U.S. PATENT DOCUMENTS

| | | | |
|---|---|---|---|
| 190,586 | 5/1877 | Henrichs | 312/199 |
| 468,184 | 2/1892 | Teel | 5/2 B |
| 487,685 | 12/1892 | Snyder | 5/2 B |
| 504,778 | 9/1893 | Flory | 5/2 B |
| 641,614 | 1/1900 | Stebbins | 312/250 |
| 1,215,240 | 2/1917 | Becker | 312/317 R |
| 2,174,260 | 9/1939 | Foulkes | 312/201 |
| 2,247,020 | 6/1941 | Hilckman | 312/140.4 |
| 2,313,690 | 3/1943 | White | 312/238 |
| 2,520,506 | 8/1950 | Mankki | 312/238 |
| 2,614,017 | 10/1952 | Mugnier | 312/250 |
| 2,772,639 | 12/1956 | Ingold | 312/201 |
| 2,941,659 | 6/1960 | Thrower et al. | 312/238 |
| 3,378,325 | 4/1968 | Mayer | 312/250 |
| 3,395,959 | 8/1968 | White | 312/317 R |
| 3,537,769 | 11/1970 | Di Carlo | 312/250 |
| 3,844,633 | 10/1974 | Frederick | 312/209 |
| 4,026,616 | 5/1977 | Kuehl | 312/250 |
| 4,084,125 | 4/1978 | King | 312/250 |
| 4,109,328 | 8/1978 | Mason | 5/8 |
| 4,123,126 | 10/1978 | Querengasser | 312/198 |
| 4,126,366 | 11/1978 | Handler et al. | 312/125 |

FOREIGN PATENT DOCUMENTS

| | | | |
|---|---|---|---|
| 866205 | 4/1961 | United Kingdom | 312/201 |

*Primary Examiner*—Victor N. Sakran

*Attorney, Agent, or Firm*—Michael E. Kiteck, Jr.

[57] ABSTRACT

A roller supported cabinet which may be moved upon the rollers along the wall behind it. One end of the cabinet normally rests in a corner of the room. When the cabinet is moved away from the corner, complete and ready access is had to the shelves and drawers of the end portion which was in the corner behind an adjoining cabinet along the adjacent wall. With the cabinet extended from the corner the usually wasted corner cabinet space may be fully utilized. When the cabinet is returned to the corner location, it takes up a minimum of space in the room.

2 Claims, 7 Drawing Figures

CABINET CONSTRUCTION

BACKGROUND OF THE INVENTION

This invention relates to a movable base cabinet to be used for storage of various items. More particularly, it relates to a movable cabinet supported by rollers parallel to the wall behind the cabinet. When extended from its normal corner location, complete access is had to the front of the cabinet.

In U.S. Pat. No. 4,026,616, description is made of a roll out drawer cart which is removable from a cabinet and which may be rolled to another location.

The drawer cart of the above referenced patent rolls out to the front rather than rolling to the side and could not be used in a corner location.

In U.S. Pat. No. 2,313,690, description is made of a corner cabinet module with a countertop portion that swings up to provide access to the corner area. This provides access through the top of the corner area which means that only the top shelf may be reached. It is impossible to gain access to more than one level of storage so that much of the corner space is still unusable.

Accordingly, it is an object of the present invention to provide a movable base cabinet providing access to the corner portion of the cabinet.

It is another object of the invention to provide a cabinet which rolls to the side to provide access to the corner portion of the cabinet at the front of the corner portion.

It is still another object of the invention to provide a movable kitchen cabinet supported on rollers in a solid and economical construction which may be rolled into a corner and extended along the wall behind it to provide complete access through the front to the corner portion.

Other U.S. patents considered during the application, but not believed pertinent to the present invention are:

U.S. Pat. No. 1,215,240; Becker;
U.S. Pat. No. 3,395,959; White;
U.S. Pat. No. 3,844,633; Frederick;
U.S. Pat. No. 4,084,125; King.

DESCRIPTION OF THE PREFERRED EMBODIMENT

Figure 1:
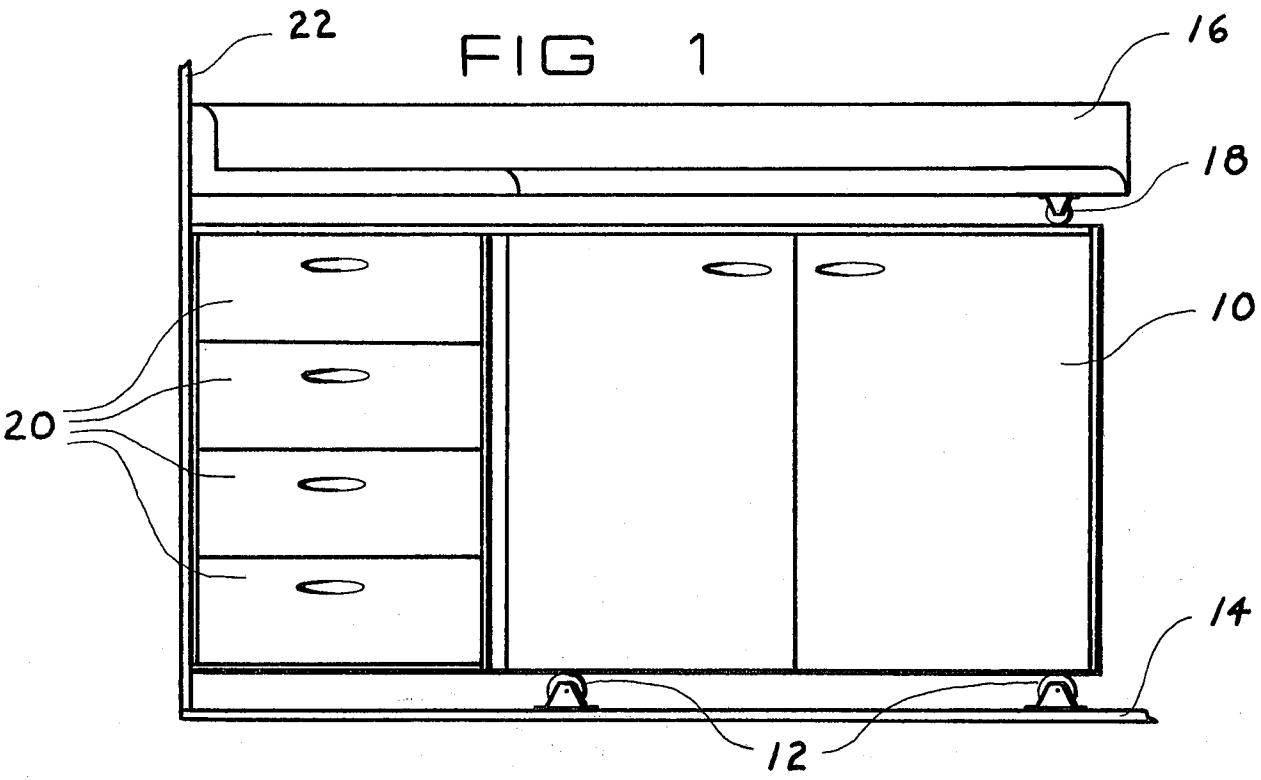
FIG. 1 is a front elevational view of a cabinet of this invention retracted to the corner location.
Figure 2:
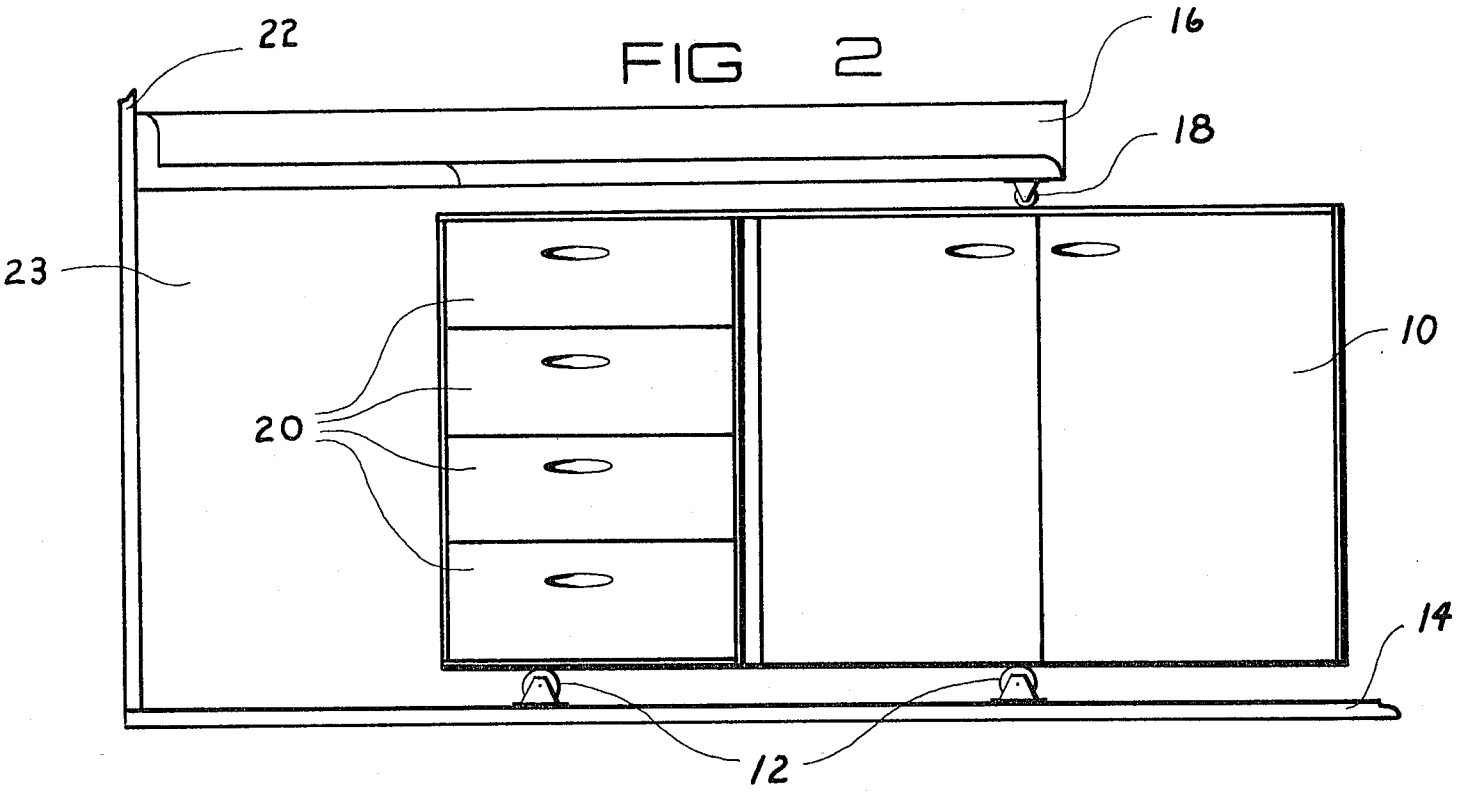
FIG. 2 is a front elevation of the same extended to allow access to the corner portion of the cabinet.

Referring to FIGS. 1 and 2, a preferred embodiment of the invention is shown therein. The movable cabinet 10 is supported by rollers 12 beneath it mounted to the floor 14 of the room in which the movable cabinet 10 is located. Alternatively, the movable cabinet 10 is supported on rollers attached to the bottom of the cabinet or upon rollers attached to the wall 23 behind movable cabinet 10 and tracks mounted to the back of the cabinet. A further alternative is to replace the rollers with a track and slider of low friction material.

Figure 4:
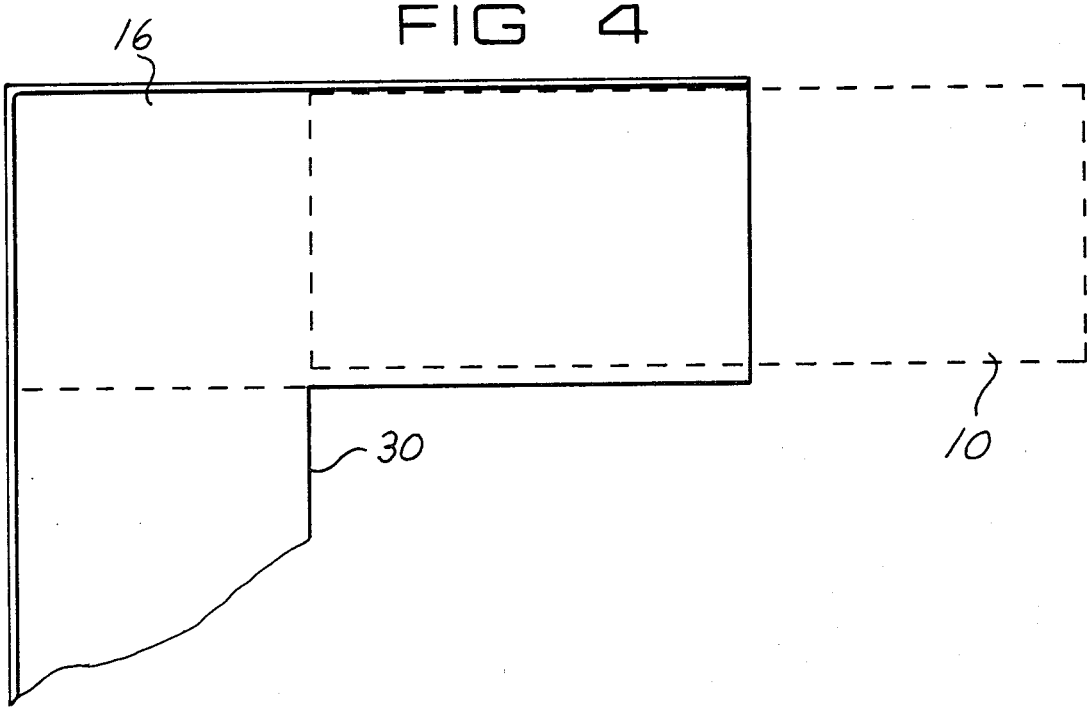
FIG. 4 is a top view of the cabinet of this invention showing the cabinet extended to allow access to the corner portion of the cabinet.

Mounted on the underside of the countertop 16 above movable cabinet 10 is a roller 18 to support the outer corner of the fixed countertop 16 by bearing upon the top of the cabinet 10. FIG. 1 shows the cabinet 10 retracted into the room corner. FIG. 2 and FIG. 4 show the cabinet 10 extended to allow access to the drawers 20.

Figure 3:
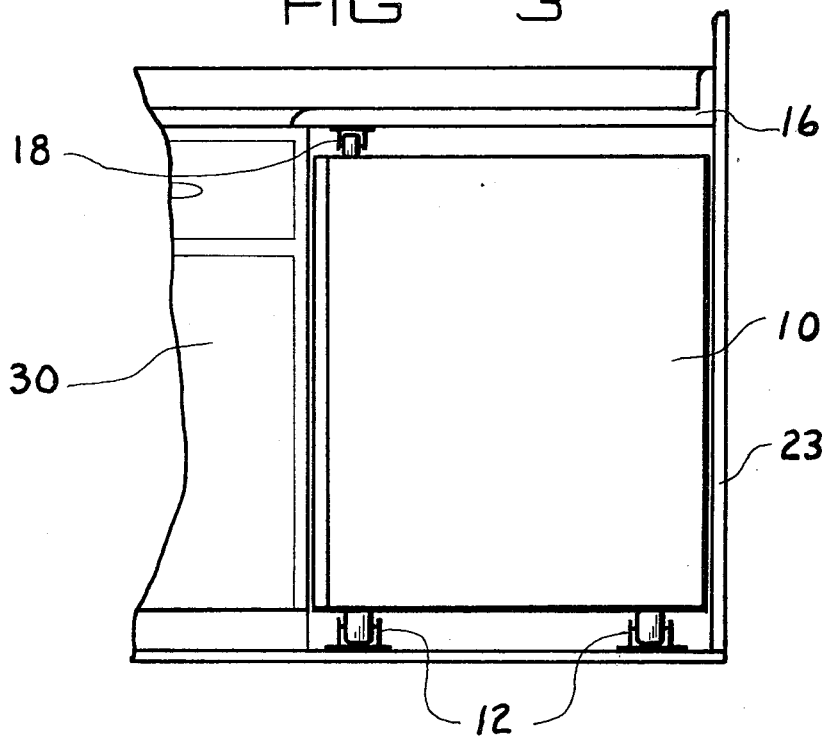
FIG. 3 is a side elevational view of the cabinet showing the floor mounted rollers, countertop roller and part of a fixed cabinet along the side wall.
Figure 5:
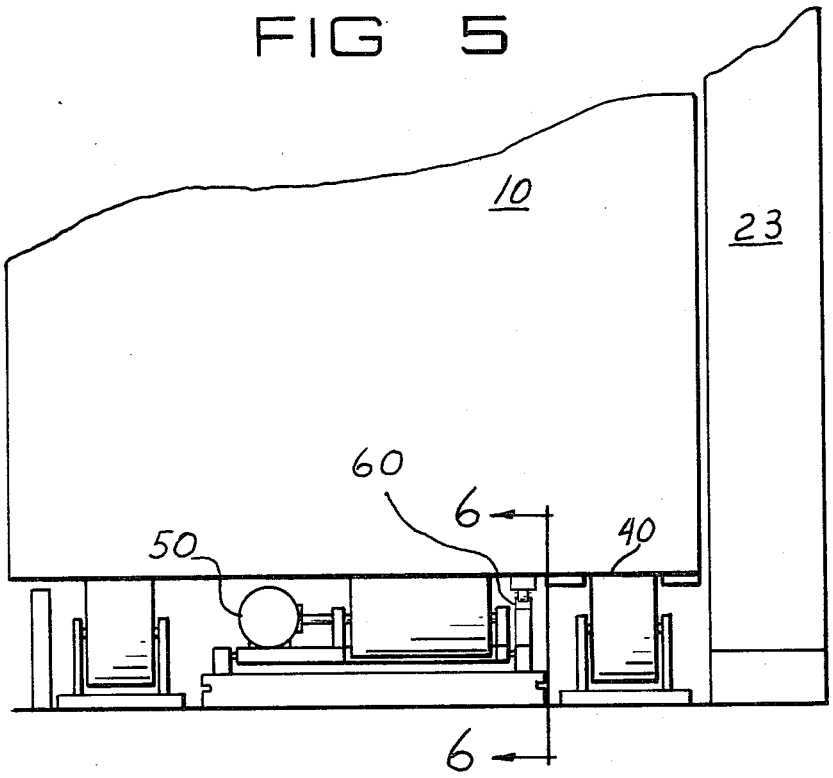
FIG. 5 is a partial side elevational view of the cabinet showing the floor mounted rollers and drive means employing an electric motor.

Referring to FIG. 3, the adjacent fixed cabinet 30 is shown in broken away front elevation. It is this adjacent cabinet 30 which blocks access to drawers 20 when the movable cabinet 10 is in the retracted position shown in FIG. 1. The movable cabinet 10 is shown in side elevation which shows the location of rollers 12 supporting movable cabinet 10 and the roller 18 supporting the countertop 16. A space between movable cabinet 10 and fixed cabinet 30 and a space between movable cabinet 10 and the wall 23 behind cabinet 10 may be seen in this end view. More positive positioning means such as grooves 40 in the bottom of movable cabinet 10, as shown in FIG. 5, to fit over rollers 12 or small recessed rollers in the wall 23 and the fixed cabinet 30 to contact the back and front of movable cabinet 10 may also be employed.

Figure 6:
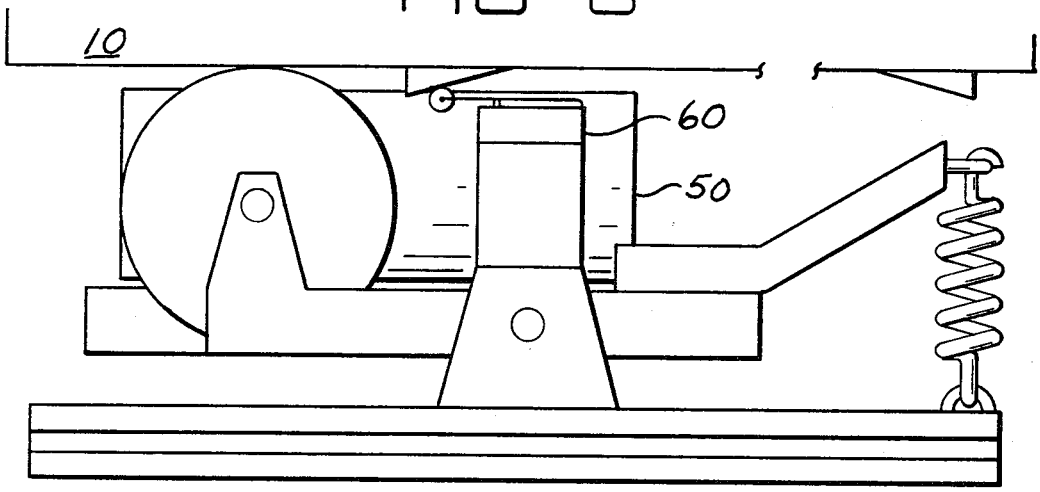
FIG. 6 is a rear elevational view on the line 6—6 of FIG. 5 showing the drive means.
Figure 7:
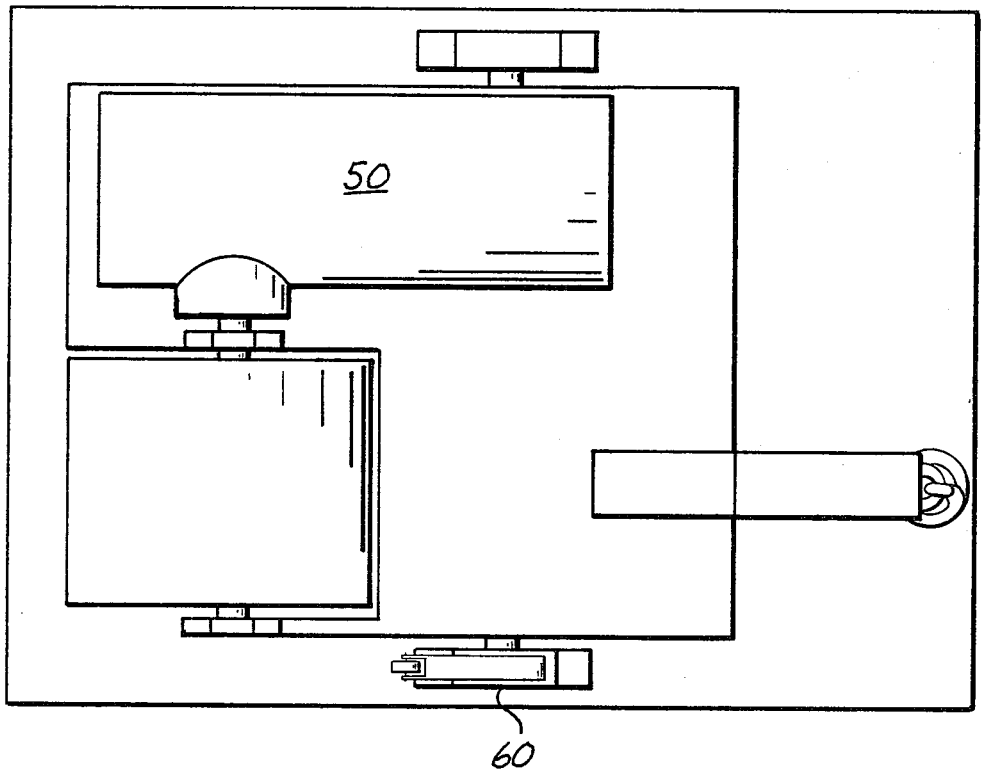
FIG. 7 is a top view of the drive means.

Stop means limiting the travel of movable cabinet 10 may also be employed. In addition, an electric motor 50, as shown in FIGS. 5, 6 and 7, or other drive means together with a control means 60, as shown in FIGS. 5, 6 and 7, may be employed to drive the movable cabinet 10 from retracted to extended position and back as an alternative to manual power.

The invention as shown allows the movable cabinet 10 to be retracted into the corner of the room for compactness so that room space may be utilized for living space. When the movable cabinet 10 is extended, full access is had to the drawers 20 or other type of cabinet facing provided. When retracted, the drawers or other facing are concealed by cabinet 30 on the adjacent wall 22.

While I have shown and described an embodiment of this invention in some detail, it will be understood that this description and illustrations are offered merely by way of example, and that the invention is to be limited in scope only by the appended claims.

Having now therefore fully illustrated and described my invention, what I claim to be new and desire to protect by U.S. Letters Patent is:

1. A cabinet construction which comprises a fixed cabinet, a cabinet movable parallel to its facing which is adjacent and perpendicular to the fixed cabinet so at a retracted position a portion of the facing of the movable cabinet abuts one end of the fixed cabinet, and at an extended position, the facing of the movable cabinet is accessible, further comprising a countertop and a roller mounted on the underside of the countertop to support the countertop by bearing upon the top of the movable cabinet.

2. The subject matter of claim 1 further comprising a wall behind the movable cabinet and a side wall behind the fixed cabinet so that in the retracted position the movable cabinet will occupy a corner location.

* * * * *